US010501942B2

(12) United States Patent
Palasek et al.

(10) Patent No.: US 10,501,942 B2
(45) Date of Patent: Dec. 10, 2019

(54) TELESCOPING RAIL ASSEMBLY

(71) Applicant: Air Distribution Technologies IP, LLC, Milwaukee, WI (US)

(72) Inventors: Steven R. Palasek, Grand Rapids, MI (US); Joshua Munger, Grand Rapids, MI (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 6 days.

(21) Appl. No.: 15/788,221

(22) Filed: Oct. 19, 2017

(65) Prior Publication Data

US 2018/0112413 A1 Apr. 26, 2018

Related U.S. Application Data

(60) Provisional application No. 62/411,313, filed on Oct. 21, 2016.

(51) Int. Cl.

| | |
|---|---|
| ***E04F 11/18*** | (2006.01) |
| ***E04B 7/18*** | (2006.01) |
| ***E04D 13/035*** | (2006.01) |
| ***E04H 17/22*** | (2006.01) |
| ***E06B 11/02*** | (2006.01) |
| ***E04H 17/14*** | (2006.01) |
| ***E04D 13/03*** | (2006.01) |
| ***F24F 7/02*** | (2006.01) |

(52) U.S. Cl.

CPC ..... *E04F 11/1836* (2013.01); *E04B 7/18* (2013.01); *E04D 13/0335* (2013.01); *E04D 13/0354* (2013.01); *E04H 17/1413* (2013.01); *E04H 17/22* (2013.01); *E06B 11/022* (2013.01); *F24F 7/02* (2013.01); *E04F 2011/187* (2013.01)

(58) Field of Classification Search

CPC ..... E04F 11/1836; E04F 2011/187; E04H 17/1413; E04H 17/22; E06B 11/022; E04D 13/0354; E04D 13/0335; E04B 7/18; E02D 29/127; E04G 21/3204; E04G 21/3223; E06C 7/006; E06C 7/182

USPC ..... 52/20, 200, 19; 256/59, 65.01, 65.02; 182/113; 248/220.1, 235, 243, 247, 250

See application file for complete search history.

(56) References Cited

U.S. PATENT DOCUMENTS 1,826,419 A * 10/1931 Butkus ..... F16B 12/58 5/300
3,901,481 A 8/1975 Probst
3,995,833 A * 12/1976 McLaughlin ..... E04G 21/3233 256/59

(Continued)

FOREIGN PATENT DOCUMENTS

EP 1365087 B1 1/2008

*Primary Examiner* — Brent W Herring
(74) *Attorney, Agent, or Firm* — Fletcher Yoder, P.C.

(57) ABSTRACT

A telescoping rail assembly for a roof hatch includes a bracket configured to couple to the roof hatch, where the roof hatch is configured to provide access to a roof of a building, a post coupled to the bracket and configured to extend from the roof hatch and outward from the roof, and a telescoping rail having a first portion and a second portion, where the first portion and the second portion are slidably adjustable with respect to one another, and where the telescoping rail is disposed along a portion of a perimeter of the roof hatch to enable the telescoping rail assembly to enclose an area that includes the roof hatch.

25 Claims, 5 Drawing Sheets

(56) References Cited

U.S. PATENT DOCUMENTS 6,053,281 A * 4/2000 Murray ..... E04G 21/3223 182/113
6,167,659 B1 * 1/2001 Swindell, III ..... E04D 13/0335 182/106
6,272,800 B1 * 8/2001 Phinney ..... E04D 13/0335 182/112
6,467,230 B1 * 10/2002 Perkins ..... E04F 11/1812 248/220.1
6,629,391 B1 * 10/2003 Børresen ..... E04D 13/031 52/200
6,679,482 B2 * 1/2004 Allenbaugh ..... E04G 21/3233 182/113
6,681,528 B1 * 1/2004 Profeta ..... E04D 13/0335 182/113
6,931,793 B2 * 8/2005 Joyce ..... E04D 13/0315 182/112
7,063,186 B1 6/2006 Granke
RE39,842 E 9/2007 Purvis et al.
7,516,575 B2 * 4/2009 Cuccurullo ..... E04D 13/0335 182/113
D620,131 S * 7/2010 Ray ..... D25/48.3
8,256,164 B2 9/2012 Cuccurullo
8,555,555 B2 10/2013 Cardwell
8,806,815 B1 * 8/2014 Liu ..... H01L 31/0422 52/173.3
8,925,904 B2 * 1/2015 Christoffer ..... E04H 17/22 182/113
D725,792 S * 3/2015 Cullen ..... D25/38.1
9,045,906 B1 6/2015 Richey et al.
9,464,440 B2 10/2016 Whiting
9,500,000 B2 * 11/2016 McCarty ..... E04H 17/1413
10,100,576 B1 * 10/2018 Dimovski ..... E06C 1/34
2004/0104382 A1 6/2004 Collins et al.
2004/0154241 A1 * 8/2004 Joyce ..... E04D 13/0315 52/200
2005/0115173 A1 * 6/2005 Joyce ..... E04D 13/0315 52/200
2010/0264390 A1 * 10/2010 Cerda ..... E02D 17/08 256/24
2011/0017967 A1 * 1/2011 Whiting ..... E04D 13/0335 256/59
2011/0083376 A1 * 4/2011 Cuccurullo ..... E04D 13/0335 52/20
2013/0219790 A1 * 8/2013 Honeycutt ..... E06B 11/045 49/176
2014/0217346 A1 * 8/2014 Cullen ..... E04D 13/0335 256/65.01
2016/0362934 A1 * 12/2016 Swafford ..... E05D 5/06

* cited by examiner

TELESCOPING RAIL ASSEMBLY

CROSS REFERENCE TO RELATED APPLICATION

This application claims the benefit of and priority to U.S. Provisional Patent Application Ser. No. 62/411,313, entitled "Telescoping Rail Assembly," filed Oct. 21, 2016, which is hereby incorporated by reference in its entirety.

BACKGROUND

The present disclosure relates generally to roof hatches, and more particularly, to a rail assembly for a roof hatch to enable access to an HVAC unit.

Roof hatches provide access to a rooftop or outdoor area of a structure from an inside portion of the structure, such as a stairwell. In some cases, rail assemblies may enclose an area surrounding the roof hatch, such that immediate access to the rooftop is substantially blocked. Accordingly, a person entering the rooftop from the roof hatch may utilize the rail assembly for support to facilitate entry onto the rooftop. In some embodiments, the rail assembly may include a gate that enables the person to enter the rooftop portion not enclosed by the rail assembly. Unfortunately, roof hatches may include a variety of sizes, such that multiple custom-sized rails may be manufactured to fit a particular roof hatch and form the rail assembly.

SUMMARY

In one embodiment, a telescoping rail assembly for a roof hatch includes a bracket configured to couple to the roof hatch, where the roof hatch is configured to provide access to a roof of a building, a post coupled to the bracket and configured to extend from the roof hatch and outward from the roof, and a telescoping rail having a first portion and a second portion, where the first portion and the second portion are slidably adjustable with respect to one another, and where the telescoping rail is disposed along a portion of a perimeter of the roof hatch to enable the telescoping rail assembly to enclose an area that includes the roof hatch.

In another embodiment, a rail system for a roof hatch includes a bracket configured to couple to the roof hatch, where the roof hatch is configured to provide access to a roof of a building, a post coupled to the bracket and configured to extend vertically from the roof hatch with respect to the roof, a first telescoping rail having a first portion and a second portion, where the first portion and the second portion are slidably adjustable with respect to one another, and where the first telescoping rail is disposed along a first portion of a perimeter of the roof hatch to enable the rail system to enclose an area that includes the roof hatch, and a telescoping gate having a second telescoping rail, where the second telescoping rail includes a third portion and a fourth portion that are slidably adjustable with respect to one another, and where the telescoping gate is disposed along a second portion of the perimeter of the roof hatch.

In another embodiment, a method of assembling a telescoping rail assembly for a roof hatch includes coupling a bracket of the telescoping rail assembly to the roof hatch, mounting a post to the bracket of the telescoping rail assembly, adjusting a telescoping rail of the telescoping rail assembly to a predetermined length by sliding a first portion of the telescoping rail with respect to a second portion of the telescoping rail, and coupling the telescoping rail to the post.

DRAWINGS

DETAILED DESCRIPTION

Embodiments of the present disclosure relate to a rail assembly that includes telescoping rails to simplify a manufacturing and installation process of the rail assembly. For instance, the telescoping rails may be configured to fit a variety of different sized roof hatches, and thus eliminate custom-sized rails that may be measured and manufactured to fit a specific roof hatch. Accordingly, the rail assembly may be constructed without obtaining rails that are sized for a specific roof hatch. As discussed above, roof hatches used as rooftop access points may not include uniform dimensions. Customized rail assemblies are manufactured for a specific roof hatch, which may be time-consuming and expensive. Additionally, manufacturing tolerances that exist in the customized rail assemblies may complicate installation of individual rails that ultimately form the rail assembly. The telescoping rails of the present disclosure may be adjustable to fit a range of roof hatch sizes. Further, assembly complications resulting from manufacturing tolerances may be avoided because a length of the telescoping rails may be adjusted to facilitate assembly of the rail assembly. As such, the telescoping rail assembly of the present disclosure may reduce installation costs of roof hatches by reducing an assembly time and reducing a cost of components used to form the rail assembly.

In some embodiments, the rail assembly includes one or more telescoping rail portions, which may be mounted to a roof hatch via brackets. A length of the telescoping rail portions is adjustable by sliding a first portion of the telescoping rail with respect to a second portion of the telescoping rail to a predetermined length. The brackets are coupled to the roof hatch utilizing fasteners, such as threaded bolts or screws. Additionally, portions of the brackets may be slidably received into an opening of a telescoping rail portions or posts to support the telescoping rail portions and/or posts. The rail assembly may also include a telescoping gate portion, which may be coupled to a post via one or more hinges. As such, the telescoping gate portion may enable access to a rooftop from the roof hatch. In any case, the one or more telescoping rail portions and the telescoping gate portion may be adjustable to form the rail assembly, which ultimately encloses an area surrounding the roof hatch. The rail assembly may thus facilitate entry and exit from the roof hatch by providing support rails to a person entering or exiting the roof hatch.

Figure 1:
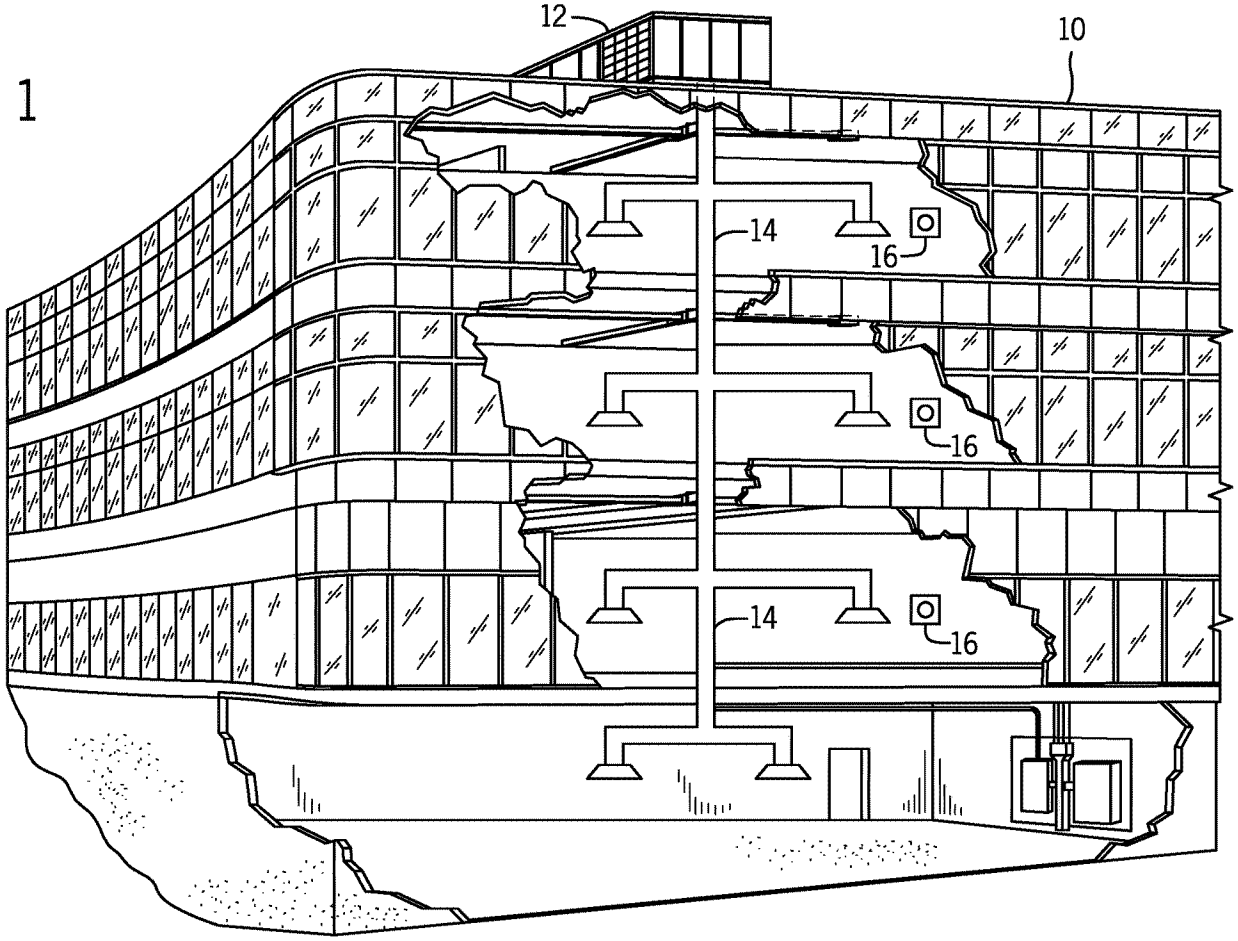
FIG. 1 is a schematic of an environmental control for building environmental management that may employ one or more HVAC units, in accordance with an aspect of the present disclosure.

Turning now to the drawings, FIG. 1 illustrates a building 10 that may be air conditioned by a system that includes an HVAC unit 12. The building 10 may be a commercial structure or a residential structure. As shown, the HVAC unit 12 is disposed on the roof of the building 10. Accordingly, an operator may access the roof of the building 10 via a roof hatch, or roof access hatch door, to perform maintenance on the HVAC unit 12, to perform maintenance on other equipment on the roof of the building 10, and/or to perform maintenance on the roof itself.

As set forth above, present embodiments are directed to a telescoping rail assembly that may surround a roof hatch, or a roof access hatch door, to facilitate access to the roof of the building 10 through the roof hatch. The rail assembly includes telescoping rails to simplify manufacturing and/or installation of the rail assembly. For instance, the telescoping rails may be configured to fit a variety of different sized roof hatches, and thus eliminate custom-sized rails that may be measured and manufactured to fit a specific roof hatch. Accordingly, the rail assembly may be installed without obtaining rails that are sized for a specific roof hatch. For example, the rail assembly includes one or more telescoping rail portions, which may be mounted to a roof hatch using brackets. The rail assembly may also include a telescoping gate portion, which may be coupled to a post of the rail assembly via one or more hinges. As such, the telescoping gate portion may enable access to a rooftop from the roof hatch. In any case, the one or more telescoping rail portions and the telescoping gate portion may be adjustable to form the rail assembly, which ultimately encloses an area surrounding the roof hatch. The rail assembly may thus facilitate entry and exit from the roof hatch by providing support rails to a person entering or exiting the roof hatch.

Figure 2:
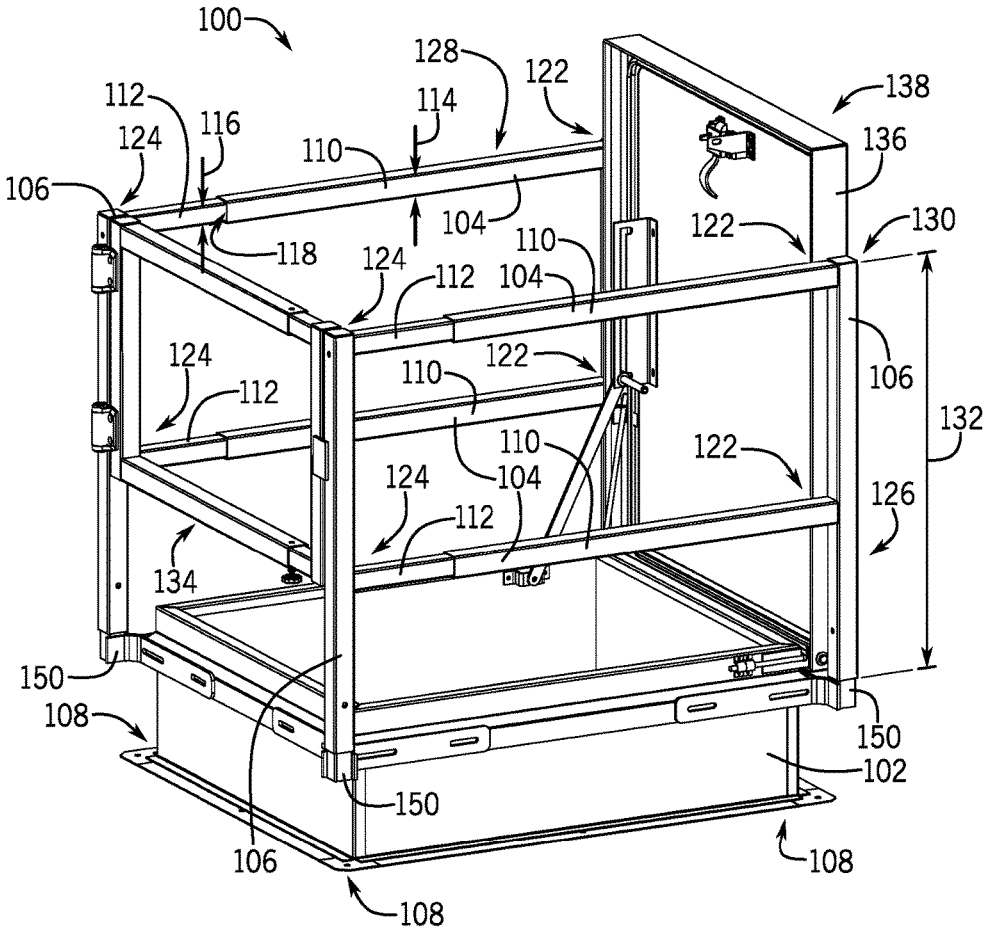
FIG. 2 is a perspective view of an embodiment of a telescoping rail assembly that may be utilized to facilitate access to a component of an HVAC system, in accordance with an aspect of the present disclosure.

FIG. 2 is a perspective view of a telescoping rail assembly 100 installed over a roof hatch 102, such as a roof access hatch door. As shown in the illustrated embodiment of FIG. 2, telescoping rails 104, such as horizontal rails, may be coupled to vertical posts 106 that are positioned on respective corners 108 of the roof hatch 102. The telescoping rails 104 may be manufactured from tubing that includes steel or another suitable metal, such as aluminum or a composite metal. While the illustrated embodiment of FIG. 2 shows the telescoping rails 104 having tubing that includes a square-shaped cross-section, in other embodiments, the telescoping rails 104 may include circular tubing or tubing having another suitable cross-sectional shape.

In any case, each of the telescoping rails 104 may include a first portion 110 and a second portion 112, where the first portion 110 includes a diameter 114 (or cross-sectional area) that is larger than a diameter 116 (or cross-sectional area) of the second portion 112. Accordingly, the second portion 112 may be disposed in an opening 118 of the first portion 110 and configured to slide along an inner surface (not shown) of the first portion 110. The first portion 110 and the second portion 112 of the telescoping rails 104 may be adjusted with respect to one another, such that the telescoping rails 104 include a length of between 10 inches and 100 inches, between 20 inches and 70 inches, or between 30 inches and 48 inches. Accordingly, the telescoping rail assembly 100 may be configured to be disposed around any roof hatch that includes lengths within such ranges without manufacturing custom-sized pieces.

As shown in the illustrated embodiment of FIG. 2, first ends 122 of the first portion 110 and second ends 124 of the second portion 122 may be secured to the vertical posts 106 of the rail assembly 100. In some embodiments, the first ends 122 and the second ends 124 may be welded to the vertical posts 106. In other embodiments, the first ends 122 and the second ends 124 may be secured to the vertical posts 106 using a fastener, such as a threaded bolt and nut, a threaded screw, or another suitable fastener. In still further embodiments, the first ends 122 and the second ends 124 may be disposed over brackets or protrusions extending from the vertical posts 106.

As shown in the illustrated embodiment of FIG. 2, a first side 126 and a second side 128 of the rail assembly 100 may include two of the telescoping rails 104. For example, a first telescoping rail 104 is positioned near a top portion 130 of the vertical posts 106 and a second telescoping rail 104 is positioned at approximately half of a length 132 of the vertical posts 106. However, in other embodiments, the first and second sides 126 and 128 of the rail assembly 100 may include one of the telescoping rails 104 or more than two of the telescoping rails 104, such as three, four, five, six, seven, eight, nine, ten, or more of the telescoping rails 104. As shown in the illustrated embodiment of FIG. 2, the rail assembly 100 includes the first and second sides 126 and 128 having the telescoping rails 104, a telescoping gate 134, and a lid 136 of the roof hatch 102, which together, surround the roof hatch 102. However, in other embodiments, a third side 138 of the rail assembly 100 includes the telescoping rails 104 instead of the lid 132 of the roof hatch 102, such that the lid 132 of the roof hatch 102 is not utilized to surround the roof hatch 102. In still further embodiments, the roof hatch 102 may include a shape that is not rectangular, such that the rail assembly 100 may include any suitable number and/or combination of sides having the telescoping rails 104, the telescoping gate 130, and/or the lid 132 of the roof hatch 102 to conform to a shape of, and thus, surround the roof hatch 102.

Figure 3:
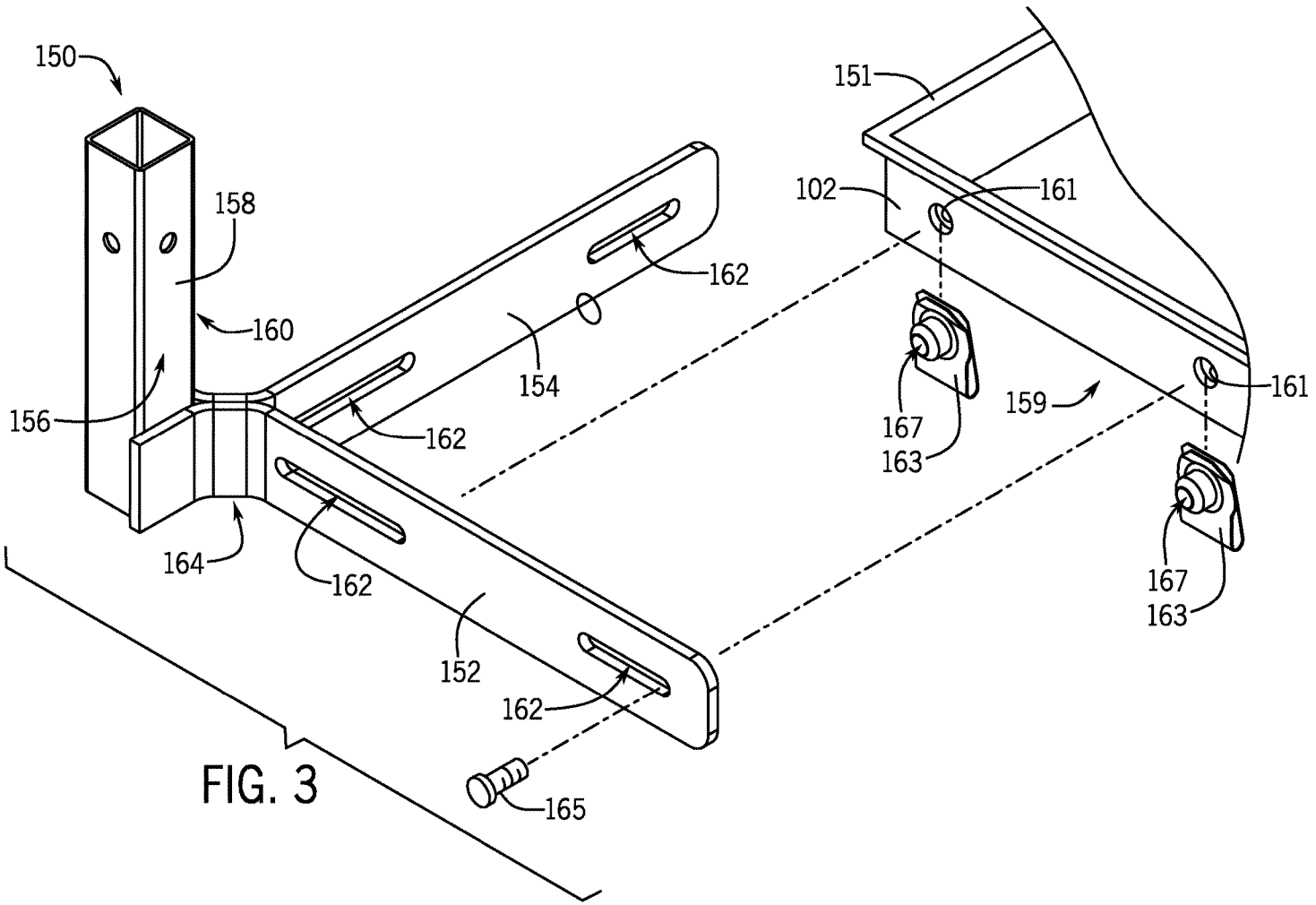
FIG. 3 is a perspective view of an embodiment of a bracket for coupling the telescoping rail assembly of FIG. 2 to a roof hatch, in accordance with an aspect of the present disclosure.

FIG. 3 is a perspective view of brackets 150 that may be utilized to couple the rail assembly 100 to the roof hatch 102 (and/or the telescoping rails 104 to the vertical posts 106). For example, the brackets 150 may be formed by coupling a first bracket portion 152 and a second bracket portion 154 to a first side 156 of a mounting post 158 and a second side 160 of the mounting post 158, respectively. In some embodiments, the first bracket portion 152 and the second bracket portion 154 may be welded to the mounting post 158. In other embodiments, the first bracket portion 152 and the second bracket portion 154 may be secured to the mounting post 158 using another coupling device or technique, such as adhesives, fasteners, brazing, or another suitable technique.

In any case, the first bracket portion 152 and the second bracket portion 154 may each include slots 162. The slots 162 may enable the first bracket portion 152 and the second bracket portion 154 to be coupled to the roof hatch 102. For example, the roof hatch 102 may include prefabricated openings, such as threaded openings, which may be configured to facilitate coupling of a railing assembly to the roof hatch 102. In other embodiments, a clip 163 may be disposed over a lip 159 of the roof hatch 102 (e.g., a bottom portion of a cap 151 of the roof hatch 102). The clip 163 may be disposed over openings 161 of the roof hatch 102 to facilitate securing of the bracket 150 to the roof hatch. For example, a fastener 165 is disposed through the slots 162 of the first bracket portion 152 and the second bracket portion 154, through an opening 167 of the clip 163, and through the openings 161 of the roof hatch 102. In some cases, at least a portion of the opening 167 of the clip 163 may be threaded, such that the opening 167 acts as a nut that secures the bracket 150 to the roof hatch 102 when the fastener 165 is threaded into the opening 167. In any case, including the slots 162 may enable the brackets 152 and 154 to accommodate multiple types of roof hatches because the slots 162 may enable the fastener 165 to couple the bracket 150 to the roof hatch 102 over a range of distances from the corners 108 of the roof hatch 102 to a respective prefabricated opening of the roof hatch 102. In some embodiments, the brackets 152 and 154 may extend approximately 12 inches from a joint 164 where the first bracket 152 and the second bracket 154 contact one another (or contact the mounting post 158). In other embodiments, the brackets 152 and 154 may extend any suitable distance from the joint 164, such that the rail assembly 100 may be secured to the roof hatch 102.

When the first bracket 152 and second bracket 154 are coupled to the roof hatch 102, the mounting post 158 may extend vertically from the roof hatch 102 with respect to the roof of the building 10. Thus, the vertical posts 106 may be disposed over, or received within, the mounting posts 158, thereby coupling the vertical posts 106 to the roof hatch 102. For example, in some embodiments, the vertical posts 106 may include a diameter or cross-sectional area that is greater than the mounting post 158, such that the mounting post 158 slides into an opening of the vertical post 106. The vertical post 106 and the mounting post 158 may then be secured to one another using a fastener, such as a threaded bolt. In other embodiments, the mounting post 158 may include a diameter or cross-sectional area greater than the vertical post 106, such that the vertical post 106 may be received in an opening of the mounting post 158. Additionally, in such embodiments, a fastener may secure the mounting post 158 and the vertical post 106 to one another.

Figure 4:
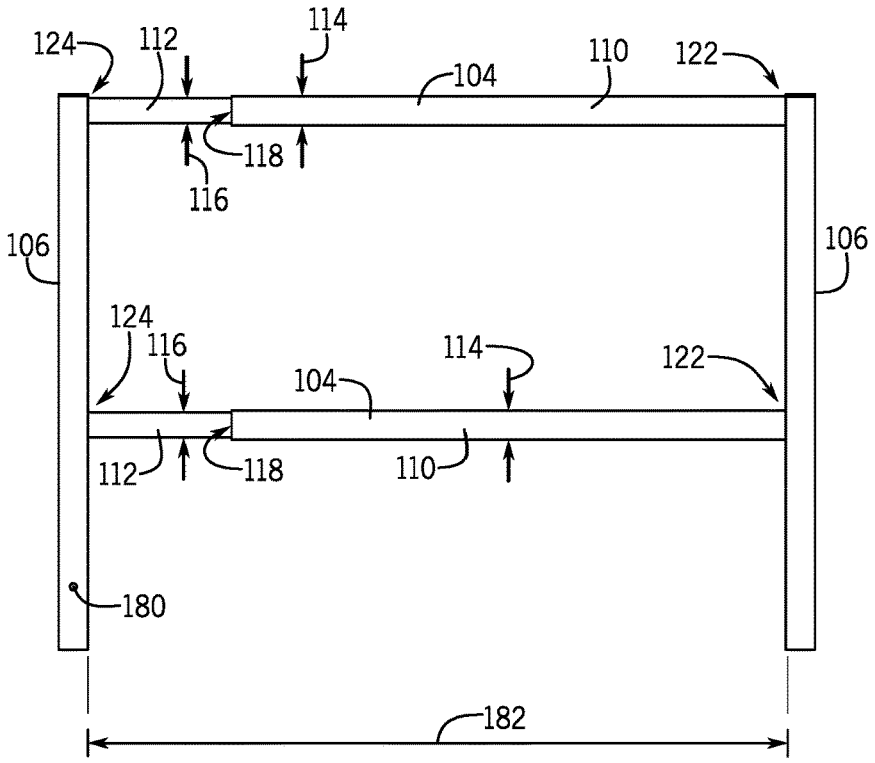
FIG. 4 is a plan view of an embodiment of telescoping rails coupled to vertical posts of the telescoping rail assembly of FIG. 2, in accordance with an aspect of the present disclosure.

FIG. 4 is a plan view of the telescoping rails 104 coupled to the vertical posts 106 at the first ends 122 of the first portions 110 and the second ends 124 of the second portions 112. As shown in the illustrated embodiment of FIG. 4, the vertical posts 106 may include an opening 180. The opening 180 may be configured to receive a fastener, such as a threaded bolt or screw, and secure the vertical posts 106 to corresponding brackets 150 that are directly coupled to the roof hatch 102. In any case, the telescoping rails 104 may be adjusted to form a predetermined length 182 between the vertical posts 106. As discussed above, the vertical posts 106 are coupled to the corners 108 of the roof hatch 102 via the brackets 150, and thus, the predetermined length 182 may be based on a distance between adjacent corners 108 of the roof hatch 102. The telescoping rails 104 may thus surround a perimeter of the roof hatch 102 to enclose the roof hatch 102 and facilitate access to the rooftop from the roof hatch 102. To enable access to the rooftop from the roof hatch 102, the rail assembly 100 may include the telescoping gate 134. Accordingly, a person may open the telescoping gate 134 to provide an opening in the rail assembly 100 along the perimeter of the roof hatch 102 for a person to walk through.

Figure 5:
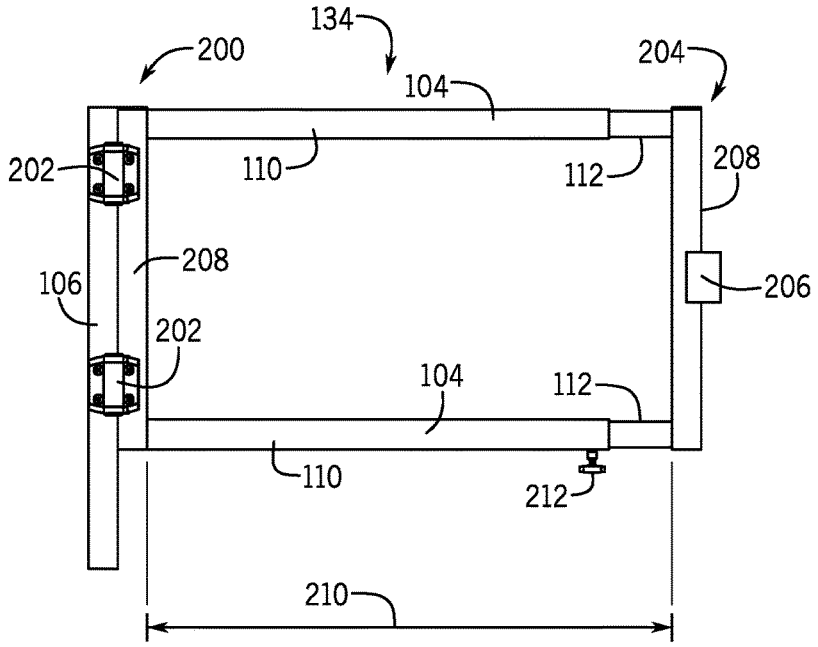
FIG. 5 is a plan view of an embodiment of a telescoping gate that may be included in the telescoping rail assembly of FIG. 2, in accordance with an aspect of the present disclosure.

For example, FIG. 5 is a side view of the telescoping gate 134 that may be included in the rail assembly 100. As shown in the illustrated embodiment of FIG. 5, the telescoping gate 134 may be coupled to one of the vertical posts 106 on a first end 200 via hinges 202, such that the telescoping gate 134 may rotate about the vertical post 106 to open and close. Accordingly, the telescoping gate 134 may be opened to enable a person to exit from a space enclosed by the rail assembly 100. A second end 204 of the telescoping gate 134 may not be coupled to a vertical post 106, but rather be configured to rest against a stop device 206 that is coupled to the vertical post 106 and/or a vertical frame member 208 of the telescoping gate 134. The stop device 206 may block rotation of the telescoping gate 134 at the stop device 206 to form the rail assembly 100 and enclose the roof hatch 102.

Additionally, two of the telescoping rails 104 may extend between the vertical frame members 208 of the telescoping gate 134, such that the telescoping gate 134 forms a rectangular structure that has a suitable length 210. For example, the telescoping rails 104 may be adjusted with respect to one another to form the length 210, which may correspond to a distance between the corners 108 of the roof hatch 102. The telescoping rails 104 may be coupled to the vertical frame members 208 via a weld or another suitable coupling device or technique, such as adhesives, brazing, fasteners, or another suitable technique. In some embodiments, the first portion 110 and the second portion 112 of at least one of the telescoping rails 104 of the telescoping gate 130 may be fastened together using a hand screw 212 that secures the second portion 112 of the at least one telescoping rail 104 in a substantially fixed position with respect to the first portion 110 of the at least one telescoping rail 104. In other embodiments, the first portion 110 and the second portion 112 may be secured to one another using another suitable device or technique.

Figure 6:
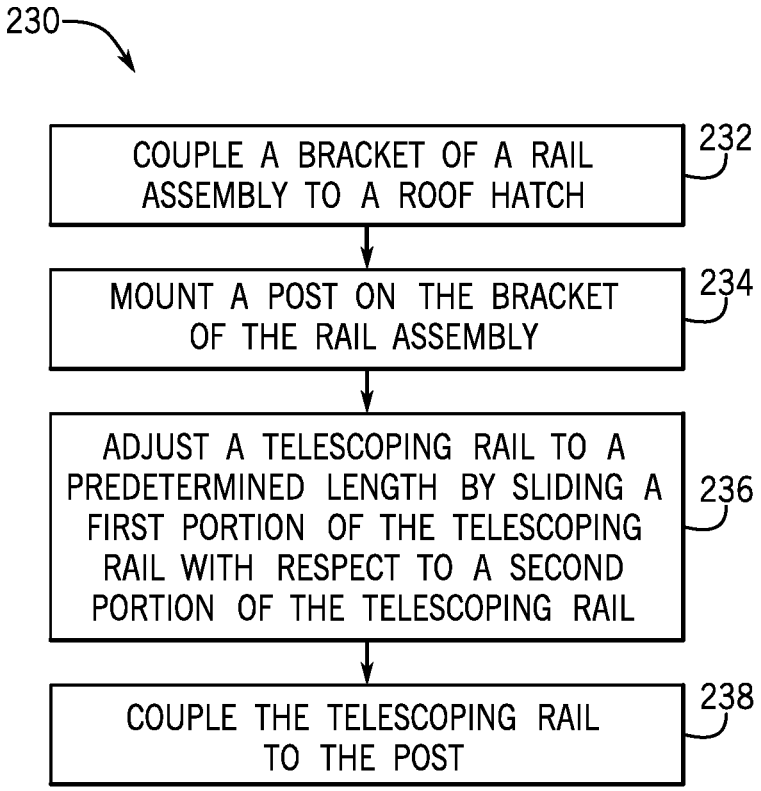
FIG. 6 is a block diagram of an embodiment of a process for installing the telescoping rail assembly of FIG. 2, in accordance with an aspect of the present disclosure.

FIG. 6 is a block diagram of an embodiment of a process 230 that may be utilized to install the rail assembly 100 of FIGS. 2-5. For example, at block 232, the bracket 150 is coupled to the roof hatch 102. In some embodiments, the bracket 150 is coupled to the roof hatch 102 at the corner 108 of the roof hatch 102. Additionally or alternatively, the bracket 150 may include the clip 163, which has the threaded opening 167 that may act as a nut to secure the bracket 150 to the roof hatch 102. For example, the fastener 165 is disposed through the slot 162, into the opening 167, and into an opening 161 of the roof hatch 102, while being threaded into the opening 167. Threading the fastener 165 into the opening 167 tightens the bracket 150, the clip 163, and the roof hatch 102 to one another, thereby securing the bracket 150 to the roof hatch 102.

At block 234, the vertical post 106 may be mounted on the mounting post 158 of the bracket 150, such that the vertical post 106 extends vertically from the corner 108 of the roof hatch 106 with respect to the roof of the building 10. At block 236, the telescoping rail 104 is adjusted to the length 182 between corners 108 of the roof hatch 102 and coupled to the vertical post 106. As discussed above, the telescoping rail 104 may be adjusted by sliding the first portion 110 of the telescoping rail 104 and the second portion 112 of the telescoping rail 112 with respect to one another. Further, the telescoping rail 104 may be coupled to the vertical post 106 via welding, brazing, adhesives, a fastener, another suitable technique, or any combination thereof.

As set forth above, the telescoping rail assembly of the present disclosure may provide one or more technical effects useful in reducing an installation time and/or installation costs of a roof hatch rail assembly. For example, embodiments of the present approach may include brackets that are coupled to the roof hatch at corners of the roof hatch. As such, vertical posts may be coupled to the brackets to generate supports at the corners of the roof hatch for telescoping rails. The telescoping rails may then be adjusted to a suitable length that enables the rail assembly to surround the roof hatch before being coupled to the vertical posts. Further, some embodiments of the present disclosure include a telescoping gate, which may facilitate access from an area enclosed by the rail assembly to a rooftop. In any case, an ability to adjust a length of the telescoping rails enables the rail assembly to be modified for a variety of roof hatch sizes, which may reduce installation time and/or costs. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode, or those unrelated to enablement). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A telescoping rail assembly for a roof hatch, comprising:

a bracket configured to couple to the roof hatch, wherein the roof hatch is configured to provide access to a roof of a building, wherein the bracket includes a mounting post having a first side and a second side adjacent to the first side, a first bracket portion configured to couple to the first side of the mounting post, and a second bracket portion configured to couple to the second side of the mounting post, wherein the first bracket portion and the second bracket portion are coupled to one another at a joint, the first bracket portion and the second bracket portion extend away from the joint, away from one another, and along the first and second sides of the mounting post, respectively, the bracket is disposed at a corner of the roof hatch, and the mounting post extends vertically from the roof hatch;

a post having an opening extending therethrough, wherein the post is configured to slidably receive the mounting post of the bracket via the opening, and wherein the post is configured to extend from the roof hatch and outward from the roof; and a telescoping rail coupled to the post, wherein the telescoping rail comprises a first portion and a second portion, wherein the first portion and the second portion are slidably adjustable with respect to one another, and wherein the telescoping rail is disposed along a portion of a perimeter of the roof hatch to enable the telescoping rail assembly to enclose an area that includes the roof hatch.

2. The telescoping rail assembly of claim 1, wherein the first bracket portion and the second bracket portion are welded to the mounting post.

3. The telescoping rail assembly of claim 1, wherein the first bracket portion, or the second bracket portion, or both, comprise a slot configured to receive a fastener.

4. The telescoping rail assembly of claim 3, comprising a clip configured to be disposed over a lip of the roof hatch, wherein the first bracket portion comprises the slot configured to receive the fastener, and wherein a first opening of the clip is configured to be aligned with the slot of the first bracket portion and a second opening of the lip of the roof hatch.

5. The telescoping rail assembly of claim 4, wherein the first opening of the clip comprises threads for securing the bracket to the roof hatch with a fastener threaded into the first opening.

6. The telescoping rail assembly of claim 1, comprising a telescoping gate, wherein the telescoping gate comprises an additional telescoping rail, wherein the additional telescoping rail comprises a third portion and a fourth portion that are slidably adjustable with respect to one another.

7. The telescoping rail assembly of claim 6, wherein the telescoping gate is coupled to the post via hinges.

8. The telescoping rail assembly of claim 6, wherein the telescoping gate comprises a frame member coupled to the additional telescoping rail.

9. The telescoping rail assembly of claim 8, wherein the frame member comprises a stop device configured to block rotation of the telescoping gate at the stop device.

10. The telescoping rail assembly of claim 1, wherein the post, or the telescoping rail, or both comprise steel tubing.

11. The telescoping rail assembly of claim 1, wherein the post, or the telescoping rail, or both comprise tubing with a substantially square-shaped cross-section.

12. The telescoping rail assembly of claim 1, wherein the telescoping rail is coupled to the post via a weld.

13. The telescoping rail assembly of claim 1, wherein the first portion of the telescoping rail comprises a first diameter, wherein the second portion of the telescoping rail comprises a second diameter, and wherein the first diameter is larger than the second diameter to enable the second portion to slide along an internal surface of the first portion.

14. The telescoping rail assembly of claim 1, comprising the roof hatch, wherein the roof hatch comprises a lid configured to enable access to the roof from an interior of the building, and wherein the lid of the roof hatch is disposed along an additional portion of the roof hatch when in an open position.

15. The telescoping rail assembly of claim 1, wherein the opening of the post includes a diameter that is greater than a cross-sectional area of the mounting post.

16. A rail system for a roof hatch, comprising:

a bracket configured to couple to the roof hatch, wherein the roof hatch is configured to provide access to a roof of a building, wherein the bracket includes a mounting post having a first side and a second side adjacent to the first side, a first bracket portion configured to couple to the first side of the mounting post, and a second bracket portion configured to couple to the second side of the mounting post, the first bracket portion and the second bracket portion are coupled to one another at a joint, the first bracket portion and the second bracket portion extend away from the joint, away from one another, and along the first and second sides of the mounting post, respectively, the bracket is disposed at a corner of the roof hatch, and the mounting post extends vertically from the roof hatch;

a post having an opening extending therethrough, wherein the post is configured to slidably receive the mounting post of the bracket via the opening, and wherein the post is configured to extend vertically from the roof hatch with respect to the roof;

a first telescoping rail comprising a first portion and a second portion, wherein the first portion and the second portion are slidably adjustable with respect to one another, and wherein the first telescoping rail is disposed along a first portion of a perimeter of the roof hatch to enable the rail system to enclose an area that includes the roof hatch; and a telescoping gate comprising a second telescoping rail, wherein the second telescoping rail comprises a third portion and a fourth portion that are slidably adjustable with respect to one another, and wherein the telescoping gate is disposed along a second portion of the perimeter of the roof hatch.

17. The system of claim 16, wherein the telescoping gate is coupled to the post via hinges.

18. The system of claim 16, wherein the telescoping gate comprises a frame member coupled to the additional telescoping rail.

19. The system of claim 18, wherein the frame member comprises a stop device configured to block rotation of the telescoping gate at the stop device.

20. The system of claim 16, wherein the first portion of the telescoping rail comprises a first diameter, wherein the second portion of the telescoping rail comprises a second diameter, and wherein the first diameter is larger than the second diameter to enable the second portion to slide along an internal surface of the first portion.

21. The system of claim 16, wherein the opening of the post includes a diameter that is greater than a cross-sectional area of the mounting post.

22. A method of assembling a telescoping rail assembly for a roof hatch, comprising:

coupling a bracket of the telescoping rail assembly to the roof hatch, wherein the bracket includes a mounting post having a first side and a second side adjacent to the first side, a first bracket portion configured to couple to the first side of the mounting post, and a second bracket portion configured to couple to the second side of the mounting post, and wherein the first bracket portion and the second bracket portion are coupled to one another at a joint, the first bracket portion and the second bracket portion extend away from the joint, away from one another, and along the first and second sides of the mounting post, respectively, and the bracket is disposed at a corner of the roof hatch;

mounting a post to the mounting post of the bracket by sliding the mounting post into an opening extending through the post;

adjusting a telescoping rail of the telescoping rail assembly to a predetermined length by sliding a first portion of the telescoping rail with respect to a second portion of the telescoping rail; and coupling the telescoping rail to the post.

23. The method of claim 22, wherein coupling the telescoping rail to the post comprises welding the telescoping rail to the post.

24. The method of claim 22, comprising coupling a telescoping gate to the post via hinges.

25. The method of claim 22, wherein coupling the bracket of the telescoping rail assembly to the roof hatch comprises:

disposing a clip over a lip of the roof hatch;

aligning a first opening of the clip with a slot of the bracket and a second opening of the roof hatch;

disposing a fastener through the slot of the bracket, the first opening of the clip, and the second opening of the roof hatch; and threading the fastener into the first opening of the clip to secure the bracket to the roof hatch.

* * * * *